US006749132B2

(12) United States Patent
Pettit et al.

(10) Patent No.: US 6,749,132 B2
(45) Date of Patent: Jun. 15, 2004

(54) SPRAY GUN

(75) Inventors: Neville Thomas Pettit, Lymington (GB); Philip John Merrifield, Dorset (GB)

(73) Assignee: ITW Limited, Swansea (GB)

( * ) Notice: Subject to any disclaimer, the term of this patent is extended or adjusted under 35 U.S.C. 154(b) by 58 days.

(21) Appl. No.: 10/080,511

(22) Filed: Feb. 25, 2002

(65) Prior Publication Data

US 2002/0166902 A1 Nov. 14, 2002

(30) Foreign Application Priority Data

Feb. 26, 2001 (GB) ..... 0104730

(51) Int. Cl.[7] ..... B05B 1/28; B05B 7/12
(52) U.S. Cl. ..... 239/296; 239/407
(58) Field of Search ..... 239/296, 407, 239/290, 291, 294, 408, 413, 416.4, 416.5, 417.3, 417.5, 424, 526

(56) References Cited

U.S. PATENT DOCUMENTS 2,462,419 A * 2/1949 Peeps ..... 239/296
3,907,202 A * 9/1975 Binoche ..... 239/705
5,209,405 A * 5/1993 Robinson et al. ..... 239/296
5,322,221 A * 6/1994 Anderson ..... 239/291
5,344,078 A * 9/1994 Fritz et al. ..... 239/296
5,799,875 A * 9/1998 Weinstein et al. ..... 239/296
5,803,367 A * 9/1998 Heard et al. ..... 239/296

* cited by examiner

*Primary Examiner*—Michael Mar
*Assistant Examiner*—Darren Gorman
(74) *Attorney, Agent, or Firm*—Lowe Hauptman Gilman & Berner LLP

(57) ABSTRACT

A spray gun includes a main body and a spray head. The spray head has an air cap, a hollow nozzle member having a nozzle tip for dispensing a liquid to be sprayed. The hollow nozzle member has a radially extending weir which together with a surface of the main body defines an air distribution chamber for receiving and distributing compressed air from a supply inlet. An annular sealing member is sealingly disposed between the radially extending weir and the surface of the main body, dividing the chamber, so that air passing into the chamber through an opening to one side of the annular wall is directed to a central aperture of the air cap and air passing into the chamber through an opening to the other side of the annular wall is directed to lateral apertures of the air cap.

16 Claims, 4 Drawing Sheets

FIG. 2
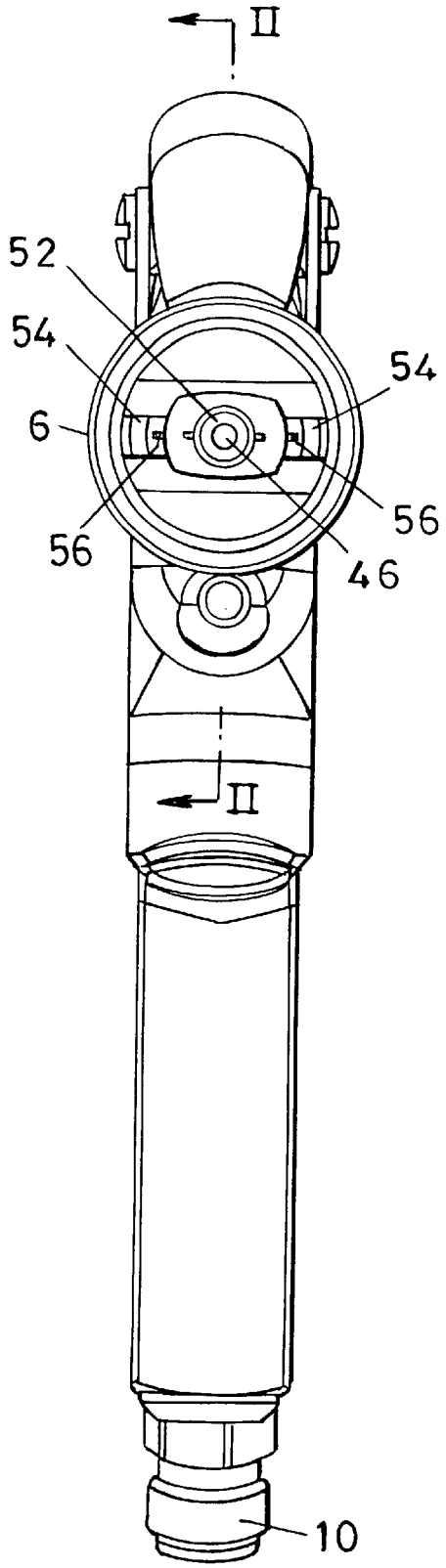
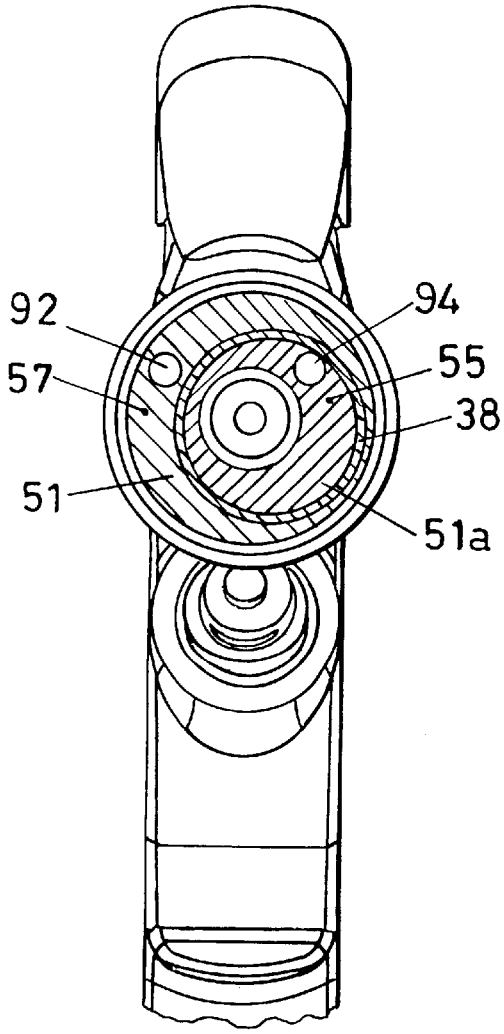
FIG. 3

SPRAY GUN

FIELD OF THE INVENTION

This invention relates to a spray gun for applying coatings such as paint in which compressed air is used both to atomise the paint to form the spray and to control the shape of the spray pattern emerging from the nozzle of the spray gun.

BACKGROUND OF THE INVENTION

Spray guns for spraying coatings such as paint, using compressed air to atomise the paint and control the shape of the resulting spray pattern, are well known. Examples of such spray guns are disclosed in, for example, U.S. Pat. Nos. 5,803,367 and 5,209,405.

Spray guns of this type typically have a spray head comprising a nozzle assembly and an air cap. The air cap has a central aperture which surrounds the paint-dispensing tip of the nozzle, such that air passing through the central aperture past the nozzle tip serves to atomise the paint to form a spray. The air cap is also provided with forwardly extending formations known generally as "horns" which direct compressed air inwardly towards the plume of atomised paint emerging from the central aperture so as to shape the plume of atomised paint to a desired pattern, such as an elliptical pattern. Usually a pair of horns are provided and these are generally arranged symmetrically with respect to the central aperture. Air used to shape the spray pattern is often referred to as "fan air" whereas air used to atomise the paint is often referred to as "atomisation air" or "atomising air".

In order to provide a supply of compressed air to both the central aperture and the horns, the incoming air must be partitioned, and in known types of spray gun, complex baffle arrangements are often employed in order to divide the incoming air stream in a consistent and controlled manner and ensure that the required pressures of atomisation air and fan air are delivered to the central aperture and horns respectively. The complexity of the baffle arrangements, and the number of parts required, can considerably complicate the manufacture of the spray guns.

SUMMARY OF THE INVENTION

It is an object of the present invention to provide a simplified means of controlling the partitioning of compressed air between fan air and atomisation air and to simplify the manufacture of the spray guns, for example by reducing the number and complexity of the parts required in the spray head.

The present invention provides an improved spray gun in which a simple annular sealing member is used to partition incoming air between atomisation air and fan air. The interior of the main body of the spray gun is configured to provide a plurality (e.g. two) of air inlet passages leading from the compressed air source (usually via an air control valve) to an air distribution chamber within the spray head, and air pathways are provided within the spray head for directing air onwards to both the horns and the central aperture. The annular sealing member serves to divide the air distribution chamber such that air passing into the chamber to one side of the sealing member is directed to the horns whilst air passing into the chamber to the other side of the sealing member is directed to the central aperture.

Accordingly, in a first aspect, the invention provides a spray gun comprising a main body, a spray head, an inlet for a liquid to be sprayed, and an inlet for a supply of compressed air;

the spray head comprising an air cap, a hollow nozzle member having a nozzle tip for dispensing the liquid, and means for securing the air cap and nozzle member to the main body;

the air cap having a central aperture through which atomising air is directed to atomise liquid dispensed through the nozzle tip to form a spray, and one or more lateral apertures through which fan air is directed for shaping the spray to a desired pattern;

the hollow nozzle member having a radially extending weir which together with a surface of the main body defines an air distribution chamber for receiving and distributing compressed air from the supply inlet;

wherein an annular sealing member having an annular wall is sealingly disposed between the radially extending weir and the said surface of the main body so as to divide the air distribution chamber, whereby air passing into the chamber thorough an opening to one side of the annular wall is directed to the central aperture of the air cap and air passing into the chamber through an opening to the other side of the annular wall is directed to the lateral apertures of the air cap.

The annular wall can be circular or non-circular, for example ovoidal or polygonal (e.g. octagonal) but preferably it is circular. The annular wall is preferably set into a recess in the said surface of the main body. This provides a simple means of locating the sealing member and ensuring that it remains in place without the need to provide additional securing means. The recess is advantageously formed by a simple machining operation into a leading surface of the main body of the spray gun. Alternatively, the recess can be formed in the surface during casting of the gun body.

For ease of manufacture, the main body of the spray gun is formed (e.g. machined) to provide a plurality (e.g. two) of air passages opening into the air distribution chamber wherein the openings are arranged symmetrically with regard to a main axis of the spray gun. In such a case, the annular wall of the sealing member may advantageously be arranged eccentrically with regard to the main axis, such that one of the air passages through the main body opens into the air distribution chamber within a region bounded by the annular wall, whilst the other symmetrically disposed air passage opens into the air distribution chamber outside the region bounded by the annular wall of the sealing member. Air from within the region bounded by the annular wall of the sealing member can then be directed onwards to the central aperture whilst air outside the region bounded by the annular wall of the sealing member can be directed onwards to the horns, or vice versa.

Typically, air from the air distribution chamber is directed to the central aperture via a path extending through the weir, whereas air is directed to the lateral apertures (horns) via a path extending around the edge of the weir. Thus the weir may be provided with one or more holes to allow movement of air between the air distribution chamber and the central aperture of the air cap.

The air cap preferably has a rearwardly extending cylindrical formation which, together with a forward surface of the radially extending weir defines an annular chamber surrounding the hollow nozzle member for receiving atomising gas from the air distribution chamber. The central aperture is typically defined by an opening in a front wall of the annular chamber, and the nozzle tip will usually protrude into the central aperture so as to define an annular flow path around the nozzle tip for the atomising gas. Air passing along the annular flow path past the nozzle tip will bring about atomisation of the paint or other coating liquid as it emerges from the nozzle tip.

The sealing member is typically formed from a plastics material, the plastics material being such that at least the edges of the annular wall are crushable or deformable to allow a seal to be created between the main body of the spray gun and the weir of the nozzle assembly. However, the sealing member should also be sufficiently rigid to be able to retain its shape and not collapse or deform to any extent under the pressure of air entering the air distribution chamber. Thus preferred plastics materials are relatively rigid plastics such as polyacetal or polyamides, or polyolefins such as polyethylene and polypropylene. A currently most preferred plastics material is high density polyethylene.

A major advantage of the sealing member is that not only does it provide a means of partitioning the air distribution chamber and dividing the flow of compressed air between atomisation and fan air, but it also provides a seal between the main body of the spray gun and the nozzle assembly thereby avoiding the requirement for a separate sealing member. The number of parts required in the spray head is thereby reduced and hence manufacture is considerably simplified.

The invention has been defined and described so far with reference to the distribution of air within the spray head. However, for the avoidance of doubt, the term "air" as used herein includes not only air as such but also any other gas that might conceivably be used for atomisation and spray pattern control in a spray gun.

The invention will now be illustrated and described in more detail, but not limited in any way, with reference to the particular embodiment shown in the accompanying drawings.

BRIEF DESCRIPTION OF THE DRAWINGS

FIG. 2 is a view from direction D of the spray gun of FIG. 1.

FIG. 3 is a partial sectional elevation along line I—I in FIG. 1.

DETAILED DESCRIPTION OF THE PREFERRED EMBODIMENTS

Figure 1:
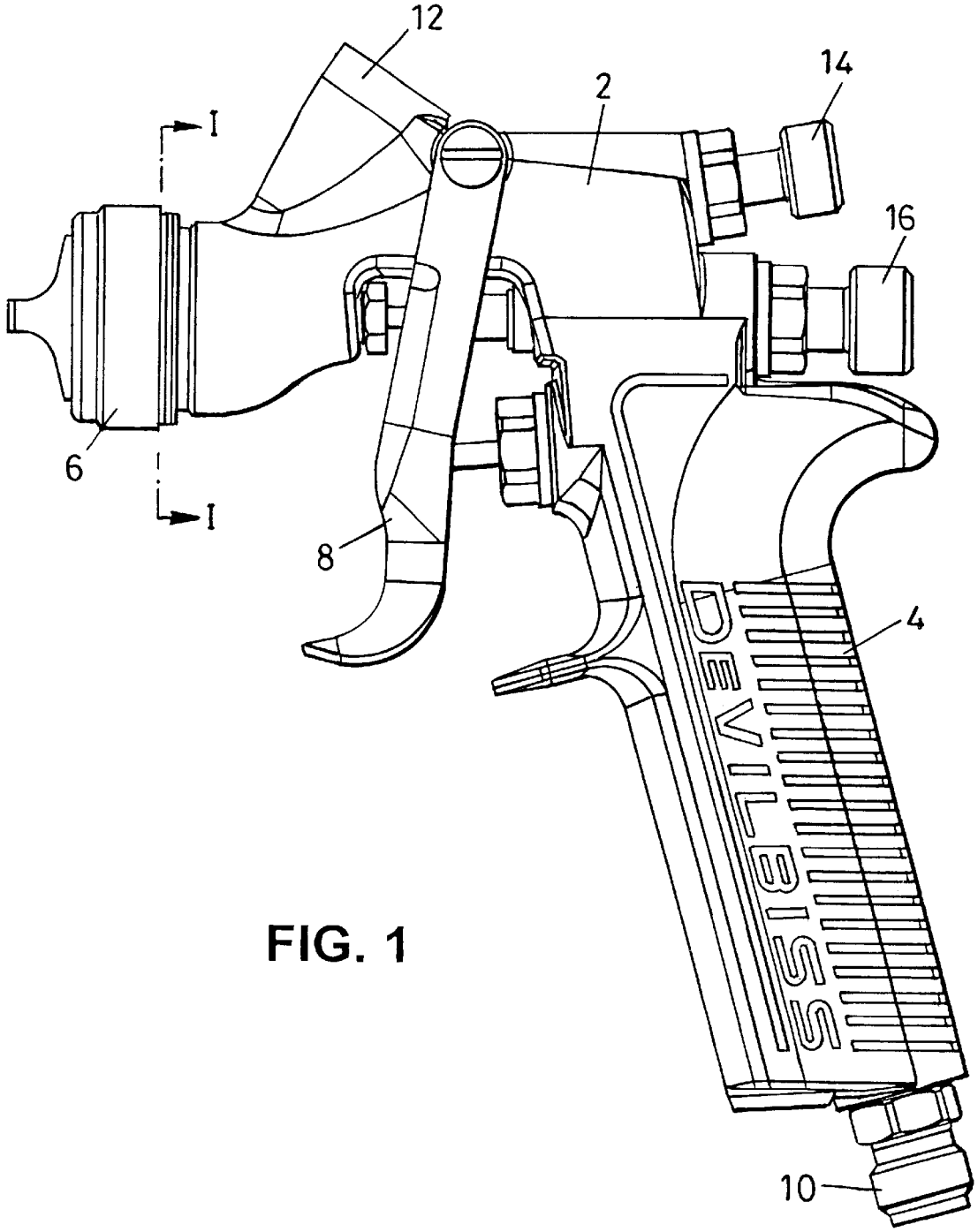
FIG. 1 is a side elevation of a spray gun according to one embodiment of the invention.

As shown in FIG. 1, a gun according to one embodiment of the invention comprises a main body 2, and a spray head 6 extending from the forward end of the body. A trigger 8 pivotably mounted on the main body 2, is provided for controlling the initiation and stopping of the paint spraying operation in standard fashion.

At the lower end of handle 4 is an inlet 10 for connection to a compressed air supply. On the upper surface of the gun body 2, an inlet formation 12 is provided for connection to a gravity feed cup containing a coating composition such as a paint or a primer.

At the rear end of the body of the spray gun, are provided control knobs 14 and 16 for controlling air flow rate and paint flow rate respectively.

Figure 4:
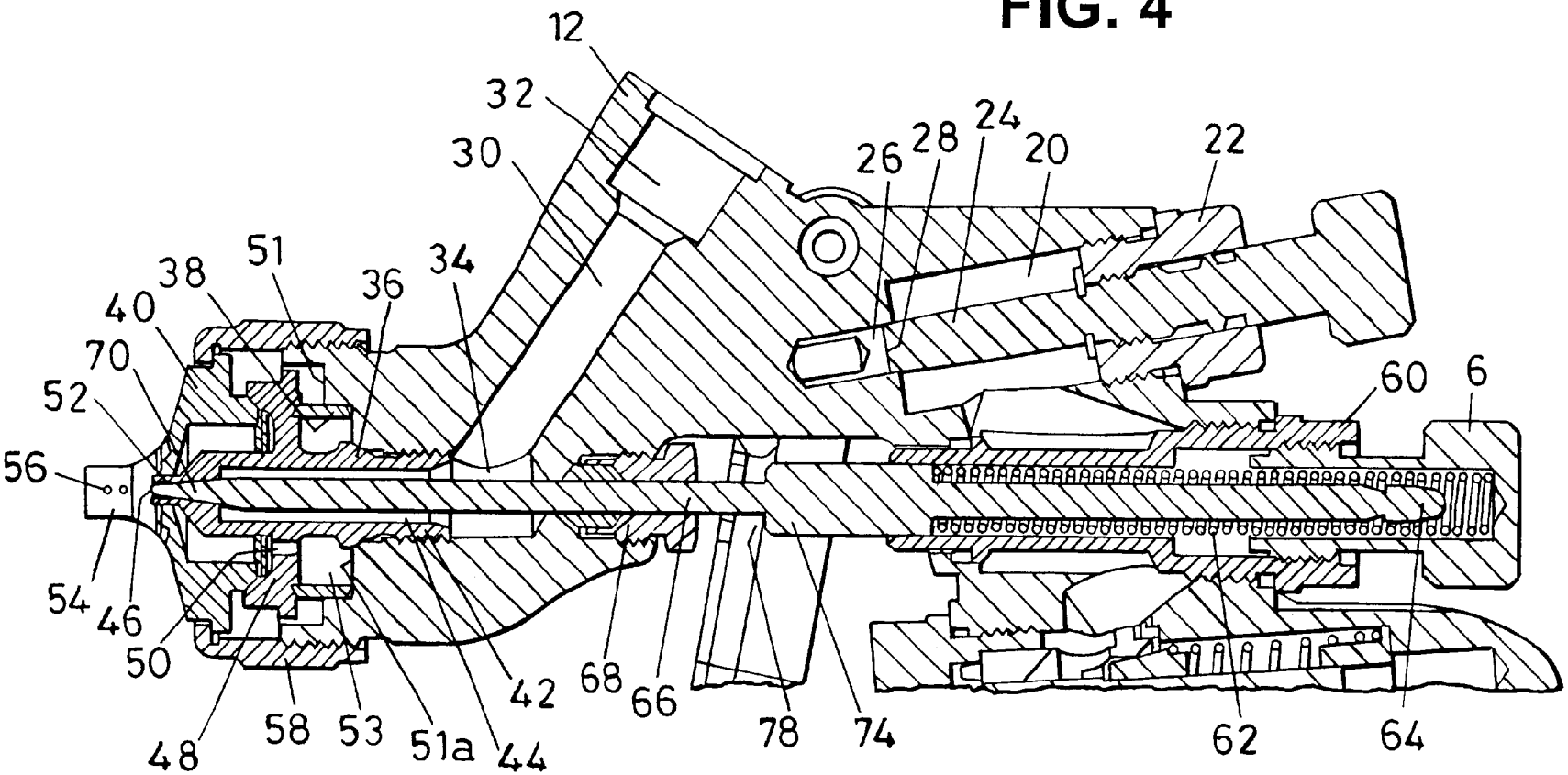
FIG. 4 is a sectional elevation along line II—II in FIG. 2.
Figure 5:
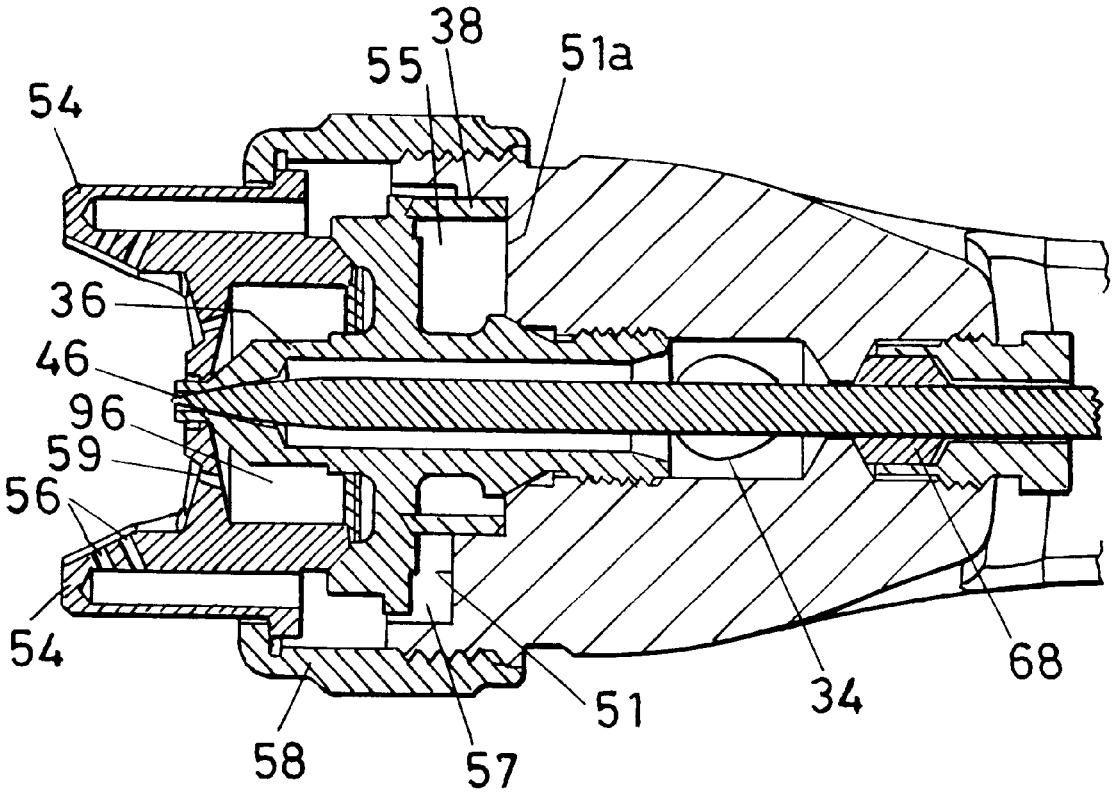
FIG. 5 is an expanded side sectional elevation through the spray head of the gun shown in FIGS. 1 to 4.

The main body 2 of the spray gun is formed from forged aluminium which has been machined and drilled out to provide the necessary passageways for conveying compressed air and paint to the nozzle. With reference to FIG. 4, air passing through inlet 10 (FIG. 1) and up through the handle is channelled into air chamber 20 which is created by machining a bore in the rear surface of the body 2. Air passing through chamber 20 is divided into atomisation air and fan air. A threaded gland 22 is seated in the mouth of chamber 20 and a control valve 24 extends through the threaded gland 22, a gas-tight seal being provided between the control valve 24 and gland 22 to prevent the escape of compressed air. At the distal end of chamber 20 is a counterbore 26 containing an opening which leads into a gas passage (not shown) that channels compressed air (fan air) towards the nozzle assembly 6 (FIGS. 1 & 4). A further opening (also not shown) channelling compressed air (atomisation air) towards the nozzle assembly is located in the wall of the chamber 20. The distal end 28 of control valve 24 is seated in counterbore 26 and serves to control the flow of air towards the nozzle assembly.

Paint inlet formation 12 (FIG. 1) takes the form of a bore 30 and counterbore 32 set into the top surface of the main body 2. The counterbore at region 32 is threaded to receive the correspondingly threaded end of a gravity feed cup (not shown) containing a reservoir of paint. Bore 30 communicates with paint dispensing chamber 34.

The nozzle assembly 6 (FIG. 1) comprises a nozzle body 36, a cylindrical sealing member 38 and an air cap 40. The nozzle body 36 is held in place by means of a threaded connection 42 into the main body 2. The nozzle body 36 has a cylindrical hollow interior 44 leading to a spray aperture in nozzle tip 46 at its forward end. Nozzle body 36 has a radially extending flange or weir 48 which has an opening 50 through which compressed air may pass in a manner described below. The radially extending weir 48 and the confronting surface 51 of the main body together form an air distribution chamber 53 into which air is channelled from the air chamber 20 and its counterbore region 26.

Clamped between the radial flange or weir 48 and the surface of the main body 2 is the cylindrical sealing member 38 which is seated in a recess 51*a* machined into the surface 51 of the main body 2. Importantly, the recess 51*a* is disposed eccentrically with regard to the axis of the spray head, as can be seen more clearly in FIG. 3. It will be appreciated that by virtue of its disposition, the cylindrical sealing member 38 divides the air distribution chamber into a region 55 bounded by the annular wall of the sealing member, and a region 57 outside the annular wall.

Arranged forwardly of the nozzle body 36 is air cap 40 that has a central aperture 52, which aperture forms an annular passage with nozzle body 36, and a pair of horns 54, one of which is shown in FIG. 4. Horns 54 each have a pair of small apertures 56 through which compressed air is directed so as to shape the pattern of the paint spray emerging when paint from the nozzle tip 46 combines with air from aperture 52. Either side of the central aperture 52 are disposed small openings 59, air passing through these holes serving to prevent paint from fouling the horns.

A retaining ring 58 is threaded onto the end of the main body 2 thereby securing the air cap 40 and locating it on to the nozzle body 36.

To the rear of the main body 2, just above the handle, is provided a paint supply adjustment screw 6. Paint supply adjustment screw is screwed by means of a thread within bearing sleeve 60 set into a bore through the main body portion. The screw 6 is hollowed out to receive a return spring 62 and shaft 64 of needle valve 66. The shaft of the needle valve passes through a sealed gland 68 and thence through the interior 44 of the nozzle body, the tip 70 of the needle valve being seated in the spray aperture of the nozzle tip 46.

Needle valve 66 has an enlarged mid portion 74 that engages a rear surface of the trigger 78. In use, movement of the trigger forces the shaft of the needle valve 66 rearwardly against the force of the return spring 64 thereby opening the aperture 46 of the paint spray nozzle tip 36 to allow paint to flow through the nozzle. The volume of paint flowing through the nozzle tip can be controlled by adjusting the control screw 6.

The passages (not shown) conveying air from the air chamber 20 and the counterbore region 26 through the main body 2 of the gun to the spray head terminate in openings 94 (FIG. 3) and 92 (FIG. 3) respectively in the front surface 51 of the main body 2. One opening (94) is set into the eccentrically machined recess 51*a* in the front surface 51 of the main body 2 and is located within the region 55 of the air distribution chamber enclosed by the annular wall of the cylindrical sealing member 38. The other hole 92 is located in the region 57 of the air distribution chamber lying outside the annular wall of the cylindrical sealing member 38.

In use, the direction of flow of air passing from the air chamber 20 and its counterbore region 26 into the nozzle is controlled by the cylindrical sealing member 38, the air emerging from hole 94 within region 55 of the air distribution chamber 53 being directed through holes 50 in weir 48 and thence into an annular chamber 96 defined by the outer surface of the nozzle 36 and the inner surface of the air cap 40. The air passing along this route serves as the atomising air, the air stream rushing past the nozzle tip serving to draw paint out through the nozzle tip whilst at the same time atomising the paint to form a spray in conventional fashion.

Air passing out through hole 92 into the region 57 of the air distribution chamber 53 is diverted around the edges of the radially extending flange or weir 48 and through flow passages (not shown) to the openings 56 in the horns 54. The air emerging from the horns serves to shape the pattern of the atomised paint emerging from the central nozzles.

The advantages of the eccentrically cyclindrical sealing member is that it allows the compressed air stream to be partitioned and channelled to either the horns or the central aperture without the need for complex labyrinthine baffles of the type found in many prior art devices. The cylindrical sealing member is formed from a material (e.g., a plastics material such as polyacetal) such that the edges of the cylinder are crushable to form gas tight seals against the weir or radial flange 48 and the surface of the main body 2 respectively. By providing an annular member that not only serves to divide the air distribution chamber but also functions as a seal, the number of parts required in the spray head is substantially reduced compared to known spray gun configurations, and manufacture is made considerably easier.

Control of the fan air volume and/or pressure, i.e. the volume and/or pressure of air passing to the horns, is effected by means of the control valve 24 which regulates the flow of air from the counterbore region 26 of chamber 20 along the passage leading to opening 92 into the air distribution chamber 53. Thus, by means of the control valve 24, fine control can be exerted over the fan air pressure and hence the shape of the paint spray pattern. However, the pressure and volume of the atomisation air is determined by the pressure input to the spray gun, and the inherent restrictions to air flow within the gun and spray head.

It will be appreciated that numerous modifications and alterations could be made to the spray gun shown in the accompanying drawings without departing from the principles underlying the invention. For example, although the sealing member is shown as being circular in plan, it could be differently shaped, for example, it could be ovoidal or polygonal, or for example hexagonal, although circular plan is preferred in order to provide ease of manufacture.

All such modifications and alterations are intended to be embraced by this application.

What is claimed is:

1. A spray gun, comprising a main body, a spray head, an inlet for a substance to be sprayed, and another inlet for a compressed gas;

the spray head comprising a hollow nozzle member having a nozzle tip for dispensing the substance, said nozzle member being secured to the main body;

wherein the hollow nozzle member together with a surface of the main body defines a gas distribution chamber for receiving and distributing the compressed gas;

said spray gun further comprises an annular sealing member sealingly disposed between the nozzle member and said surface of the main body so as to divide the gas distribution chamber, whereby a first portion of the compressed gas passing into the chamber through a first opening to one side of the annular sealing member and a second portion of the compressed gas passing into the chamber through a second opening to the other side of the annular sealing member; and the annular sealing member is arranged eccentrically with regard to a main axis of the spray head.

2. A spray gun according to claim 1, wherein the annular sealing member is circular.

3. A spray gun according to claim 1, wherein the annular sealing member is set into a recess in said surface of the main body.

4. A spray gun according to claim 3, wherein the recess has been machined into said surface of the main body.

5. The spray gun according to claim 1, wherein said spray head further comprises:

a central aperture through which the first portion of said gas is directed to atomize the substance dispensed through the nozzle tip to form a spray; and one or more lateral apertures through which the second portion of said gas is directed for shaping the spray to a desired pattern.

6. A spray gun according to claim 5, wherein the first portion of said gas is directed to the central aperture of said spray head via a path extending through the nozzle member.

7. A spray gun according to claim 5, wherein the second portion of said gas is directed to the lateral apertures of said spray head via a path extending around an edge of the nozzle member.

8. A spray gun according to claim 5, wherein the nozzle member further comprises a rearwardly extending tubular formation which, together with a forward surface of the nozzle member, at least partially defines an annular chamber surrounding the hollow nozzle member for receiving the first portion of said gas.

9. A spray gun according to claim 8, wherein said central aperture is defined by an opening in a front wall of the annular chamber.

10. A spray gun according to claim 5, wherein the nozzle tip protrudes into the central aperture so that an annular flow path is defined around the nozzle tip for atomizinig said substance with the first portion of said gas.

11. A spray gun according to claim 5, wherein the spray head further comprises a pair of horns, which horns contain at least some of the lateral apertures.

12. A spray gun according to claim 1, wherein the sealing member is formed from a plastics material.

13. A spray gun according to claim 12, wherein the plastics material is selected from the group consisting of polyacetal, polyamide, polypropylene and polyethylene.

14. A spray gun according to claim 1, wherein said spray gun is suitable for spraying paint or other protective or decorative coatings.

15. A spray gun, comprising a main body, a spray head, an inlet for a liquid to be sprayed, and an inlet for a supply of compressed air;

the spray head comprising an air cap, a hollow nozzle member having a nozzle tip for dispensing the liqiuid, and means for securing the air cap and nozzle member to the main body;

the air cap having a central aperture through which atomizing air is directed to atomize the liqiuid dispensed through the nozzle tip to form a spray, and one or more lateral apertures through which fan air is directed for shaping the spray to a desired pattern;

the hollow nozzle member having a radially extending weir which together with a surface of the main body defines an air distribution chamber for receiving and distributing the compressed air from the supply inlet;

said spray gun further comprising an annular sealing member having an annular wall and being sealingly disposed between the radially extending weir and said surface of the main body so as to divide the air distribution chamber, whereby air passing into the chamber through an opening to one side of the annular wall is directed to the central aperture of the air cap and air passing into the chamber through an opening to the other side of the annular wall is directed to the lateral apertures of the air cap;

wherein the annular wall is arranged eccentrically with regard to a main axis of the spray head.

16. A spray head for use in a spray gun, said spray gun comprising, besides said spray head, a main body, an inlet for a substance to be sprayed, and another inlet for a compressed gas, said spray head comprising:

a hollow nozzle member having a nozzle tip for dispensing the substance, said nozzle member adapted to be secured to the main body, wherein the hollow nozzle member is adapted to define, together with a surface of the main body, a gas distribution chamber for receiving and distributing the compressed gas;

an air cap having a central aperture through which a first portion of said gas is directed to atomize the substance dispensed through the nozzle tip to form a spray, and one or more lateral apertures through which a second portion of said gas is directed for shaping the spray to a desired pattern; and an annular sealing member adapted to be sealingly disposed between the nozzle member and said surface of the main body so as to divide the gas distribution chamber, whereby the first portion of the compressed gas passing into the chamber through a first opening to one side of the annular sealing member and the second portion of the compressed gas passing into the chamber through a second opening to the other side of the annular sealing member;

wherein the annular sealing member is arranged eccentrically with regard to a main axis of the spray head.

* * * * *